US011975257B2

(12) United States Patent
Janicki et al.

(10) Patent No.: US 11,975,257 B2
(45) Date of Patent: May 7, 2024

(54) PLAYGROUND APPARATUS

(71) Applicant: GROWPLAY PTY LTD, Stirling (AU)

(72) Inventors: Shane Janicki, Stirling (AU); Dylan Smith, Stirling (AU)

(73) Assignee: Growplay Pty Ltd., Stirling (AU)

( * ) Notice: Subject to any disclaimer, the term of this patent is extended or adjusted under 35 U.S.C. 154(b) by 226 days.

(21) Appl. No.: 17/536,700

(22) Filed: Nov. 29, 2021

(65) Prior Publication Data

US 2022/0168605 A1 Jun. 2, 2022

(30) Foreign Application Priority Data

Nov. 30, 2020 (AU) ..... 2020904444

(51) Int. Cl.
*A63B 9/00* (2006.01)
*A63B 71/02* (2006.01)

(52) U.S. Cl.
CPC ..... *A63B 9/00* (2013.01); *A63B 71/023* (2013.01); *A63B 2009/006* (2013.01); *A63B 2225/096* (2013.01)

(58) Field of Classification Search
CPC ... A63B 9/00; A63B 71/023; A63B 2009/006; A63B 2225/096; A63B 7/00; A63B 7/04; A63B 17/04; A63B 23/1218; A63B 2009/002; A63B 2071/024; A63B 2225/09; A63B 2225/093; A63B 17/02; A63B 17/00; A63B 2071/026; A63G 9/00; A63G 31/00; F16B 7/182; F16B 7/185

See application file for complete search history.

(56) References Cited

U.S. PATENT DOCUMENTS 2,850,306 A * 9/1958 Gordon ..... A63B 9/00 248/163.2
2,904,359 A * 9/1959 Horowitz ..... E04G 1/32 403/176
2,929,627 A * 3/1960 Scanlon ..... A63B 9/00 D25/64
3,171,654 A * 3/1965 Swanson ..... A63B 21/28 482/906
6,200,235 B1 * 3/2001 Gembarowicz ..... A63B 63/004 473/476
D536,412 S * 2/2007 Nye ..... D21/826
(Continued)

*Primary Examiner* — Garrett K Atkinson
(74) *Attorney, Agent, or Firm* — Carrier, Shende & Associates P.C.; Joseph P. Carrier; Fulchand P. Shende

(57) ABSTRACT

A playground apparatus comprises a frame adapted to rest on a ground surface, the frame comprising a pair of laterally opposed outermost sides having first ends arranged towards an outermost end of the frame and second ends opposed to the first ends, wherein the outermost sides taper inwardly towards the first ends. Monkey bars are supported by the frame above the ground surface that comprise a plurality of graspable rungs arranged in a row. The playground apparatus also comprises a pair of upright support poles, wherein uppermost sections of the upright support poles are connected to the frame towards the first ends such that the uppermost sections are laterally inwardly disposed relative to the second ends. Lowermost ends of the upright support poles extend outwardly away from one another and towards the outermost end to increase a surface area of the ground surface engaged by the upright support poles.

10 Claims, 15 Drawing Sheets

(56) References Cited

U.S. PATENT DOCUMENTS

| | | | | |
|---|---|---|---|---|
| D664,622 | S * | 7/2012 | Orsulak | D21/826 |
| 8,678,957 | B1 * | 3/2014 | Essex | A63B 71/022 473/456 |
| 9,199,263 | B2 * | 12/2015 | Hsieh | A63G 31/007 |
| 9,308,409 | B2 * | 4/2016 | Beaver | A63B 17/04 |
| 10,576,388 | B2 * | 3/2020 | Briggs | A63G 31/007 |
| 11,311,762 | B2 * | 4/2022 | Andon | A63B 17/04 |
| 11,344,762 | B2 * | 5/2022 | Bentsen | A63B 21/151 |
| 2002/0091041 | A1 * | 7/2002 | Mantooth | A63B 21/4035 482/35 |
| 2010/0304935 | A1 * | 12/2010 | Todokoro | B25B 27/00 482/35 |
| 2015/0014212 | A1 * | 1/2015 | Beaver | B65D 25/10 206/579 |
| 2018/0093135 | A1 * | 4/2018 | Roberts | A63B 71/02 |
| 2018/0133606 | A1 * | 5/2018 | Briggs | A63G 31/007 |
| 2019/0001173 | A1 * | 1/2019 | Bentsen | A63B 17/04 |
| 2019/0111295 | A1 * | 4/2019 | Watson | F16B 21/12 |
| 2020/0376315 | A1 * | 12/2020 | Andon | E04H 15/00 |
| 2021/0387036 | A1 * | 12/2021 | Leeman | A63G 31/00 |

* cited by examiner

PLAYGROUND APPARATUS

CROSS-REFERENCE TO RELATED APPLICATIONS

This application is based upon and claims the benefit of priority from Australian Patent Application No. 2020904444, filed on Nov. 30, 2020, the contents of which are incorporated herein by reference.

FIELD

The present invention relates to playground equipment and, more particularly, to a playground apparatus comprising monkey bars.

BACKGROUND

Monkey bars are items of playground equipment used for exercise and recreational purposes. A set of monkey bars typically comprises a frame that supports a set of rungs arranged generally in a row. The rungs are supported in an elevated position above the ground to allow a user to grasp and swing from them. When the user is hanging and swinging from the monkey bars, significant dynamic forces are exerted by the user on the upper parts of the frame. The frame is often, therefore, securely anchored into the ground to stop it from toppling over during use. For example, if the monkey bars are assembled on a concrete playground then the lowermost ground engaging ends of the frame may be set into the concrete, or they may be provided with mounts that are bolted into the ground.

When monkey bars are assembled on a soft ground surface, such as on a lawn, it is often not possible or practicable to anchor the frame into the ground. For some frame designs, a set of earth screws may be used as anchors but these devices must be screwed deep into the soil to work effectively. Large earth screws are expensive and difficult to install and can interfere with underground water pipe work and power cables. Some monkey bar frames, therefore, include a set of support devices, such as extension legs or braces, that extend outwardly from the perimeter of the frame and down to the ground surface. These support devices may provide additional stability but substantially increase the frame's surface area footprint. Monkey bars of this design are, therefore, only suitable for large lawns. Small lawns and courtyard areas often do not provide sufficient room to accommodate the support devices. Extension legs and braces can also present an inconvenient obstruction and hinder common gardening tasks such as lawn mowing.

It is to be understood that, if any prior art is referred to herein, such reference does not constitute an admission that the prior art forms a part of the common general knowledge in the art, in Australia or any other country.

SUMMARY

According to the present invention, there is provided a playground apparatus, comprising:

a frame adapted to rest on a ground surface, the frame comprising a pair of laterally opposed outermost sides having first ends that are arranged towards an outermost end of the frame and second ends opposed to the first ends, wherein the outermost sides taper inwardly towards the first ends;

monkey bars supported by the frame above the ground surface, wherein the monkey bars comprise a plurality of rungs arranged in a row and configured to allow a user to grasp and swing from the rungs; and at least a pair of upright support poles, wherein uppermost sections of the upright support poles are connected to the frame towards the first ends such that the uppermost sections are laterally inwardly disposed relative to the second ends, and wherein lowermost ends of the upright support poles extend outwardly away from one another and towards the outermost end to increase a surface area of the ground surface engaged by the upright support poles.

The uppermost sections of the upright support poles may be substantially vertically oriented, and the lowermost ends of the upright support poles may extend diagonally relative to the uppermost sections.

The lowermost ends of the upright support poles may comprise feet to increase a surface area of the ground surface engaged by the lowermost ends.

The outermost sides of the frame may comprise a plurality of horizontally aligned poles extending towards the outermost end of the frame, wherein the horizontally aligned poles are relatively aligned such that they inwardly converge together towards the outermost end of the frame.

The upright support poles may extend downwardly from the horizontally aligned poles and may be connected to an uppermost pair and to a lowermost pair of the horizontally aligned poles.

The monkey bars may be releasably connected to a plurality of vertically extending poles of the frame by a plurality of clamp assemblies.

The clamp assemblies may be configured such that the monkey bars are connectable to the vertically extending poles at an adjustable height relative to the ground surface.

The clamp assemblies may comprise sleeves that slidably receive the vertically extending poles, and grub screws that threadedly engage into complementary threaded bores provided in the sleeves, wherein the grub screws operatively bear against sections of the vertically extending poles received in the sleeves.

Each of the horizontally aligned poles may be connected to the frame by clamp members that receive the horizontally aligned poles, wherein the clamp members are provided with fastening means configured to engage the horizontally aligned poles only when the horizontally aligned poles are in a correct rotational orientation relative to the frame.

The fastening means may comprise screws that engage with corresponding apertures provided in the horizontally aligned poles, wherein the corresponding apertures are positioned such that they receive the screws when the horizontally aligned poles are in the correct rotational orientation.

BRIEF DESCRIPTION OF DRAWINGS

Embodiments of the invention will now be described by way of example only with reference to the accompanying drawings, in which.

DESCRIPTION OF EMBODIMENTS

Figure 1:
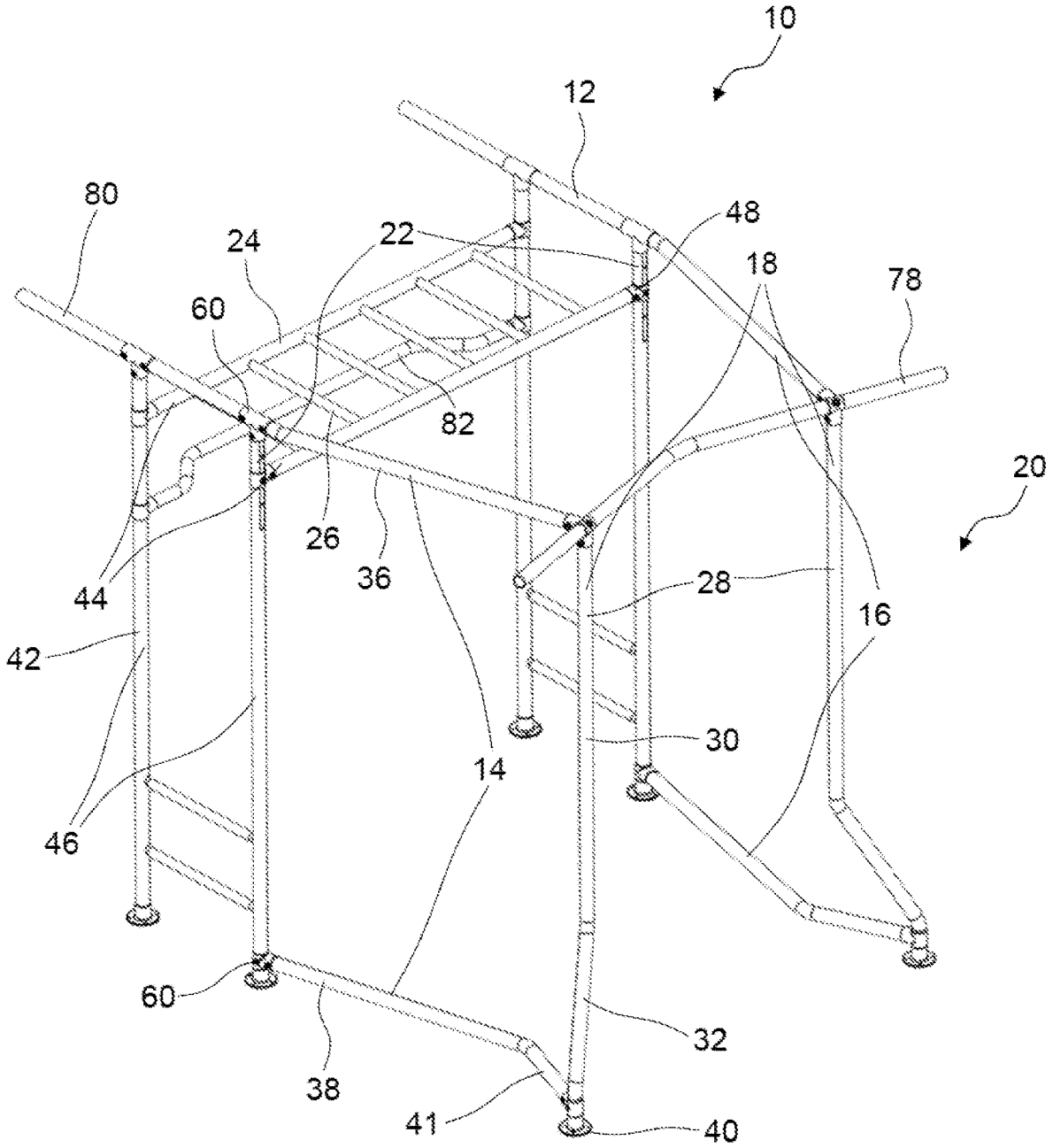
FIG. 1 is first front isometric view of a playground apparatus according to an example embodiment of the invention.
Figure 2:
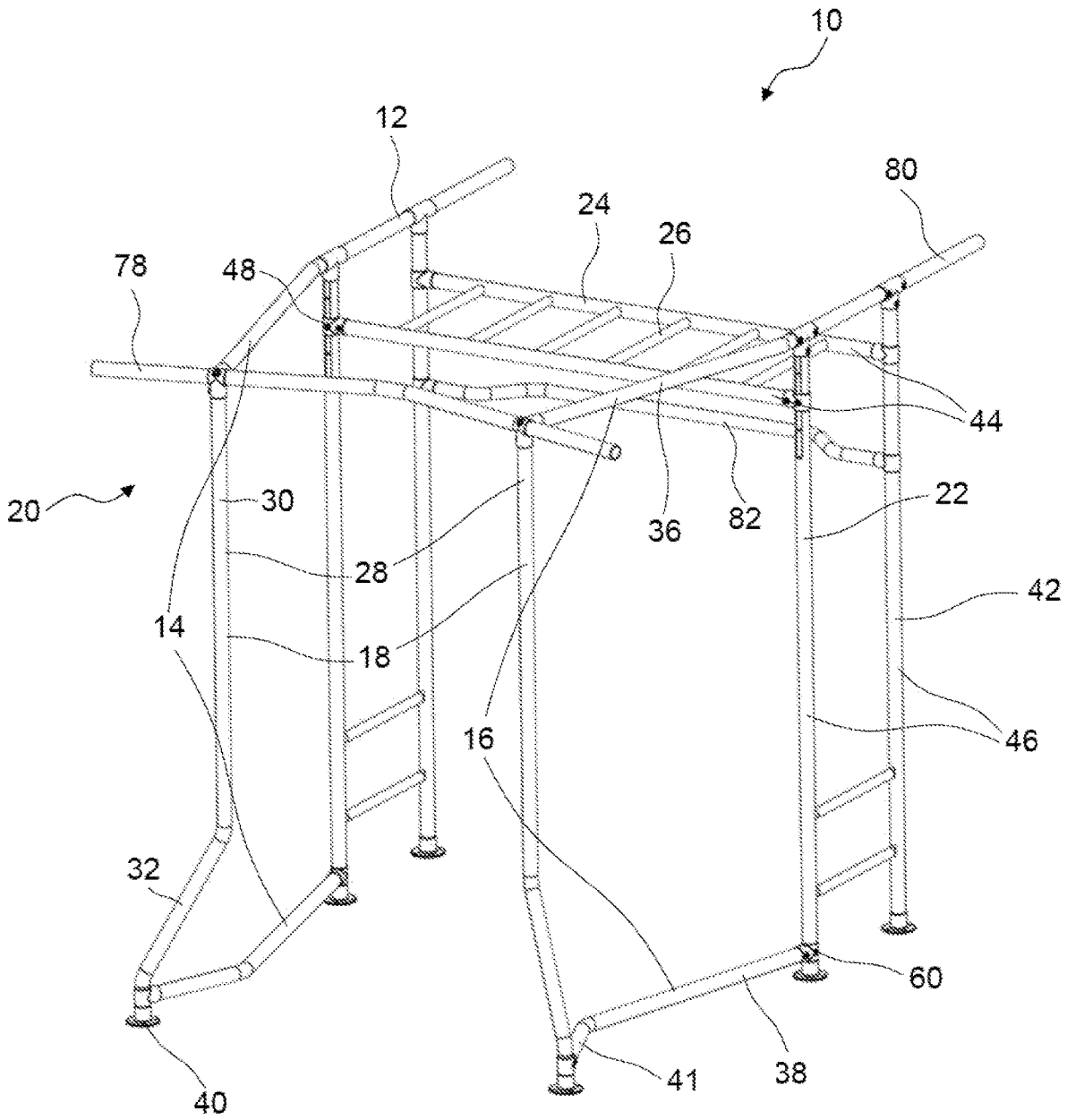
FIG. 2 is a second front isometric view of the playground apparatus.
Figure 3:
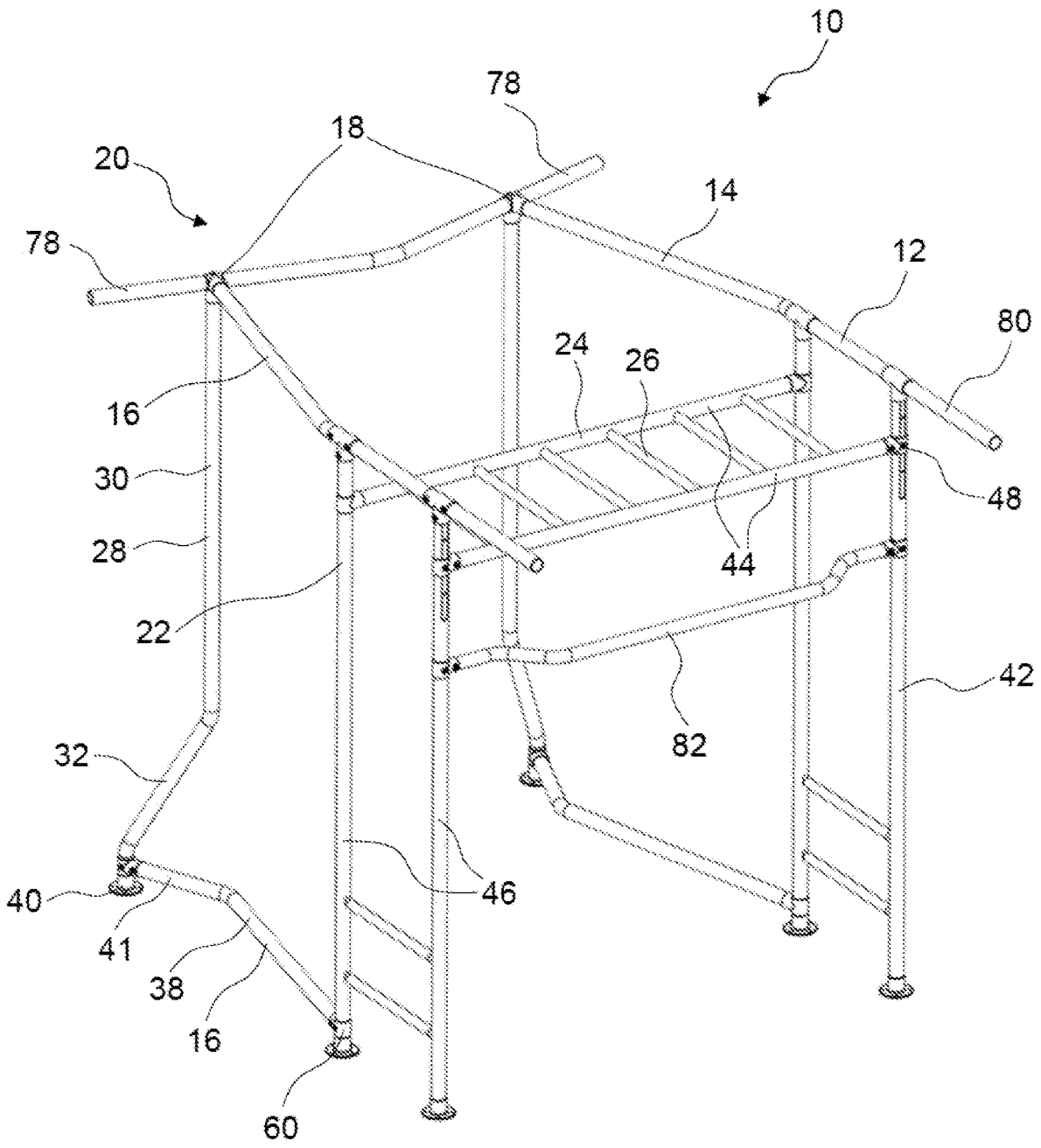
FIG. 3 is a rear isometric view of the playground apparatus.

Referring to FIGS. 1 to 7, an example embodiment of the present invention provides a playground apparatus 10. The playground apparatus 10 comprises a frame 12 that is adapted to rest on a ground surface. The frame 12 comprises a pair of laterally opposed outermost sides 14, 16 having first ends 18 that are arranged towards an outermost end 20 of the frame 12 and second ends 22 that are opposed to the first ends 18. The outermost sides 14, 16 of the frame 12 are dimensioned such that they taper inwardly towards the first ends 18. The playground apparatus 10 also comprises monkey bars 24 that are supported by the frame 12 above the ground surface, wherein the monkey bars 24 comprise a plurality of rungs 26 that are arranged in a row and are configured to allow a user to grasp and swing from the rungs 26.

The playground apparatus 10 also comprises at least a pair of upright support poles 28. Uppermost sections 30 of the upright support poles 28 are connected to the frame 12 towards the first ends 18 of the outermost sides 14, 16 such that the uppermost sections 30 are laterally inwardly disposed relative to the second ends 22 of the outermost sides 14, 16. Lowermost ends 32 of the upright support poles 28 extend outwardly away from one another and towards the outermost end 20 of the frame 20 (see FIG. 4) to increase a surface area of the ground surface engaged by the upright support poles 28.

More particularly, the two sides 14, 16 of the frame 12 may comprise a plurality of poles extending longitudinally between the first ends 18 and the second ends 22 in horizontal parallel alignment. In the example depicted, each outermost side 14, 16 comprises a pair of such horizontal poles—namely, an uppermost pole 36 and a lowermost pole 38. The two sets of horizontal poles 36, 38 provided on the frame sides 14, 16 inwardly converge towards an axis 39 (as labelled in FIG. 4) bisecting and extending longitudinally through the frame 12. The set of poles 36, 38, therefore, together define the inwardly tapered shape of the sides 14, 16. In other examples, the outermost sides 14, 16 of the frame 12 may be comprised of a different number and/or arrangement of poles that define the inwardly tapered shape of the sides 14, 16. In the example depicted, the outermost sides 14, 16 are each substantially rectangular and extend linearly between the first ends 18 and the second ends 22. However, in other examples the outermost sides 14, 16 may be non-rectangular. For example, the sides 14, 16 may be curved so as to define the inwardly tapered shape of the frame 12. More generally, the shape and configuration of the outermost sides 14, 16 (and the section of the frame 12 between the two sides 14, 16) provides that the weight distribution of the frame 12 is inwardly concentrated towards the axis 39 at the first ends 18 and, conversely, is spread out over a larger surface area either side of the axis 39 at the second ends 22.

The two sets of horizontal poles 36, 38 may terminate at the first ends 18 of the tapered sides 14, 16 where they are joined to the upright support poles 28. In this configuration, the upright support poles 28 delimit the first ends 18 and extend downwardly from the horizontal poles 36, 38 towards the ground surface. The lowermost ends 32 of the upright support poles 28 may comprise feet 40 at their base ends. The feet 40 serve to increase a total surface area of the ground surface that is engaged by the lowermost ends 32. Each of the other upright poles included in the frame 12 may also comprise feet at their lowermost ends. The lowermost horizontal poles 38 may comprise kinked outermost end sections 41 that outwardly diverge away from one another before joining the lowermost ends 32 of the upright support poles 28.

Figure 4:
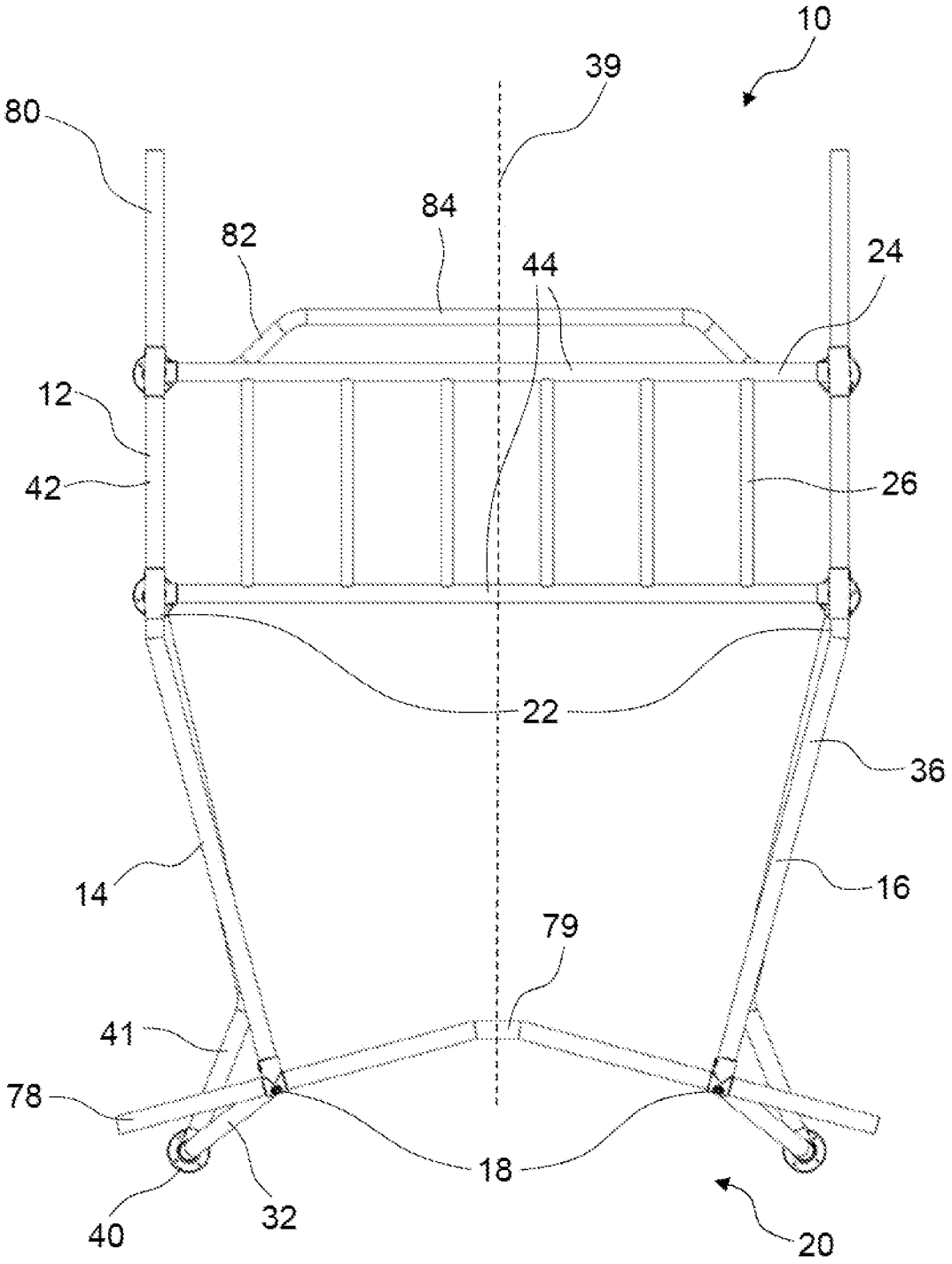
FIG. 4 is a plan view of the playground apparatus.
Figure 5:
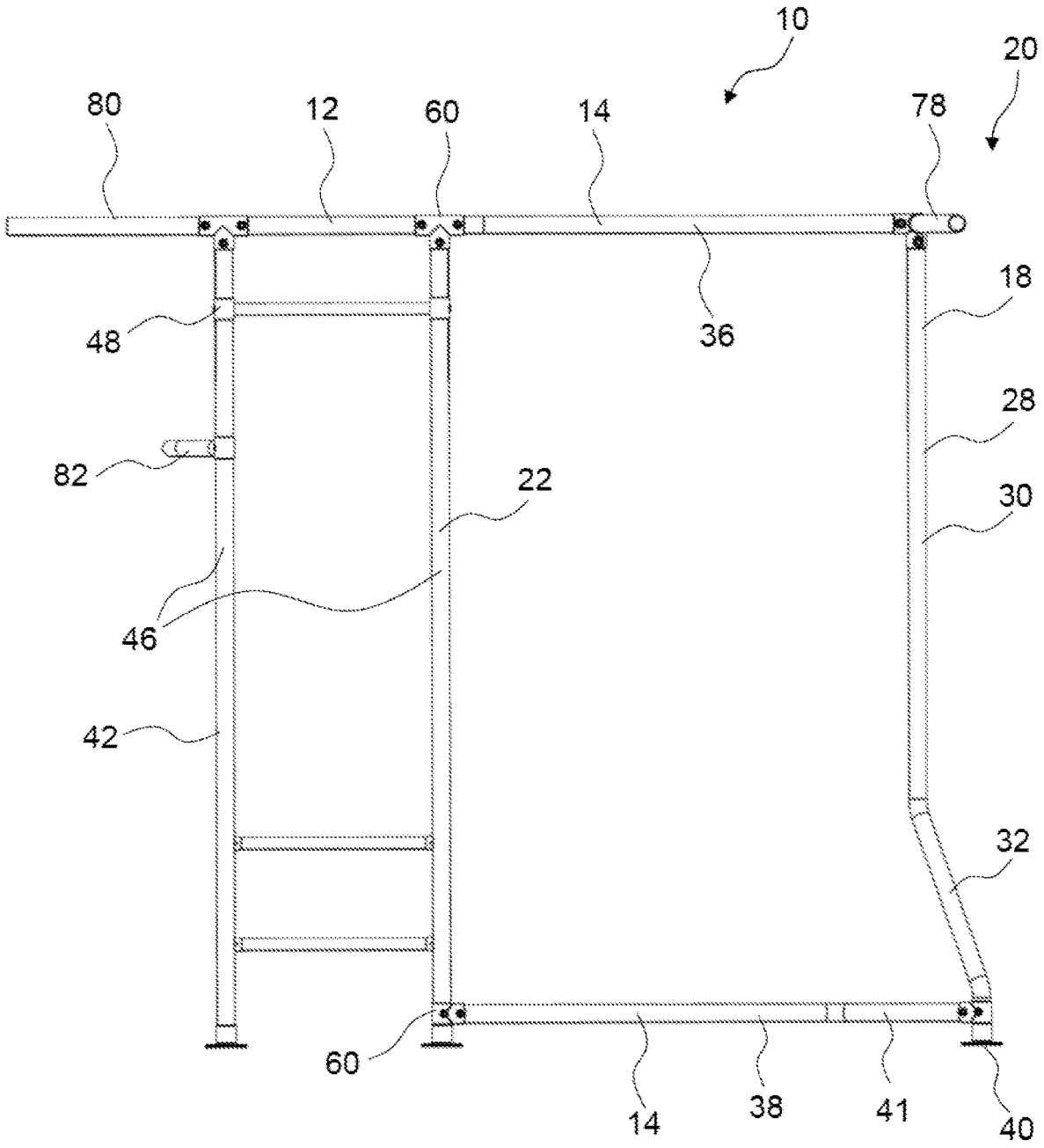
FIG. 5 is a side elevation view of the playground apparatus.
Figure 6:
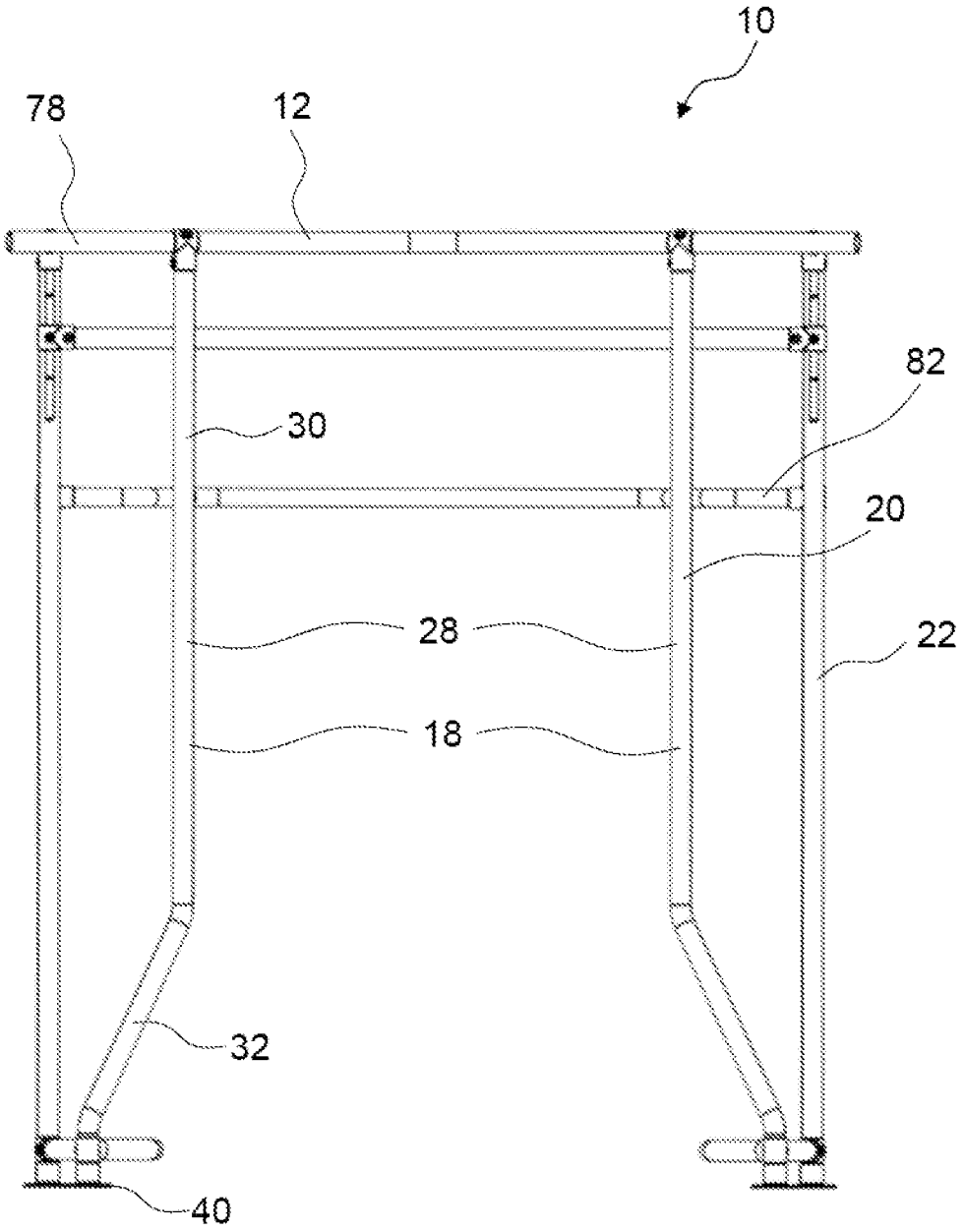
FIG. 6 is a front elevation view of the playground apparatus.
Figure 7:
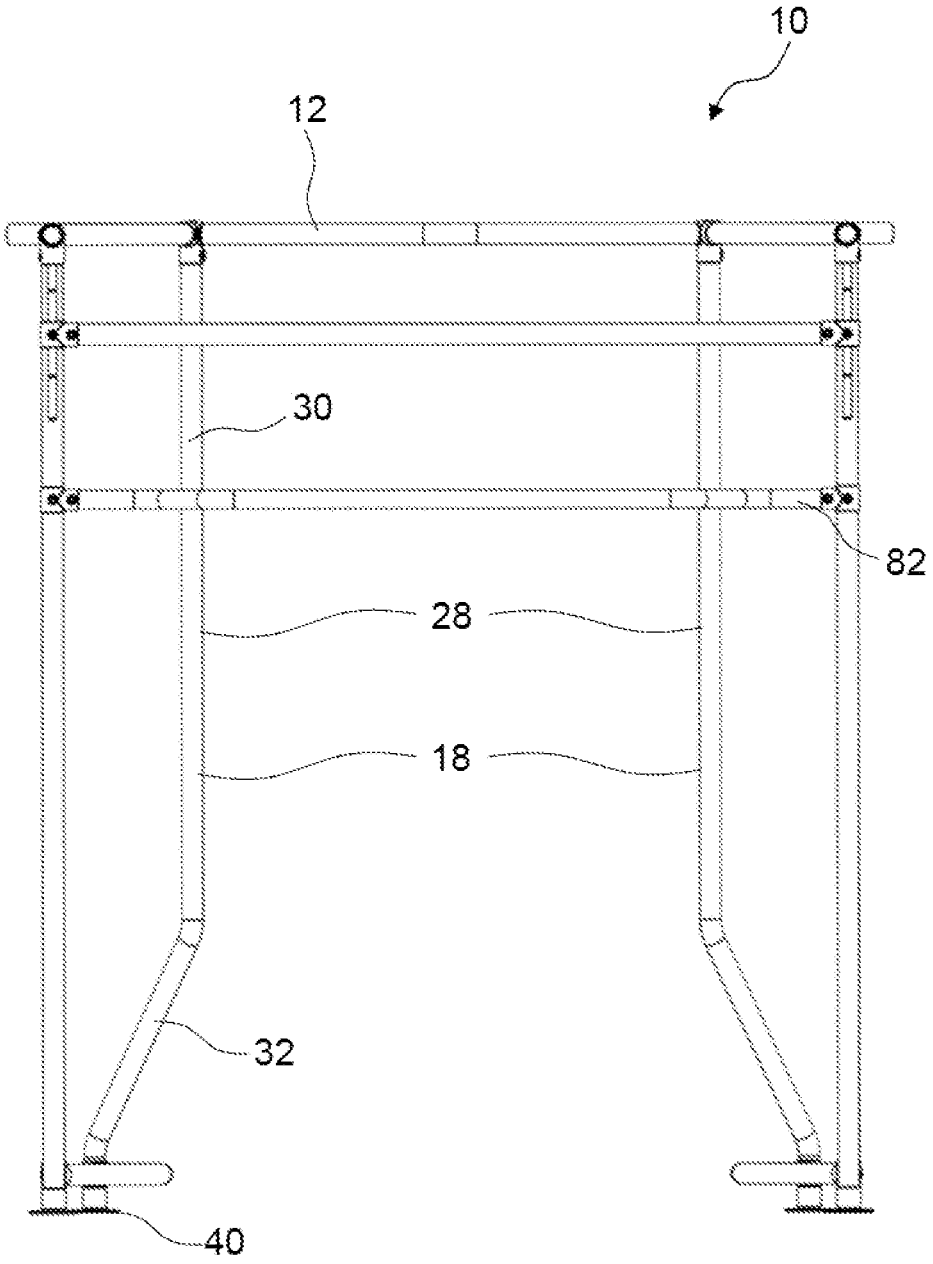
FIG. 7 is a rear elevation view of the playground apparatus.

In the example depicted in FIGS. 1 to 7, the uppermost pole sections 30 are linear and substantially vertically oriented. The lowermost ends 32 are also linear but extend diagonally outwards from the uppermost pole sections 30. As best illustrated in FIG. 4, in this configuration the lowermost ends 32 are effectively kinked and diverge away from one another such that they extend outwardly towards the lateral sides of the frame 12 in opposed directions. The lowermost ends 32 also extend outwardly towards the outermost longitudinal end 20 of the frame 12. In the example depicted, the lowermost ends 32 engage the ground surface at positions such that the distance between their respective feet 40 is less than the width of the frame 12 at ends 22. In other examples, the lowermost ends 32 may engage the ground surface such that the distance between the feet 40 is greater than or equal to the width of the frame 12 at ends 22.

The upright support poles 28 may have other shapes and configurations that cause their lowermost ends 32 to extend away from one another and towards the outermost end 20. For example, instead of extending linearly from the uppermost pole sections 30 in diagonal directions, the lowermost ends 32 may be curved (not shown) and extend from the uppermost pole sections 30 in an arcuate path away from one another and towards the outermost end 20. In another example, the upright support poles 28 may be completely straight along their entire lengths and may be connected to the horizontal poles 36, 38 such that they extend diagonally away from one another and towards the outermost end 20. In another example, the upright support poles 28 may be completely straight and be orthogonal to the ground surface but comprise extension poles connected towards their lowermost ends that extend away from one another and towards the outermost end 20.

The frame 12 may comprise a box-shaped section 42 that is provided at one end of the frame 12. The box-shaped section 42 may be connected immediately adjacent to the section of the frame 12 that has the tapered outermost sides 14, 16. The monkey bars 24 may be supported by the box-shaped section 42. For example, the monkey bars 24 may comprise a pair of elongate bars 44 extending transversely across the frame 12 between opposed sides of the box-shaped section 42. The two bars 44 may be arranged in parallel alignment and extend along the longitudinal axis of the monkey bars 24. The rungs 26 of the monkey bars 24 may extend transversely between the two elongate bars 44. For example, the rungs 26 may be oriented orthogonally relative to the elongate bars 44 and may be arranged at regular intervals along the longitudinal axis of the monkey bars 24.

Figure 8:
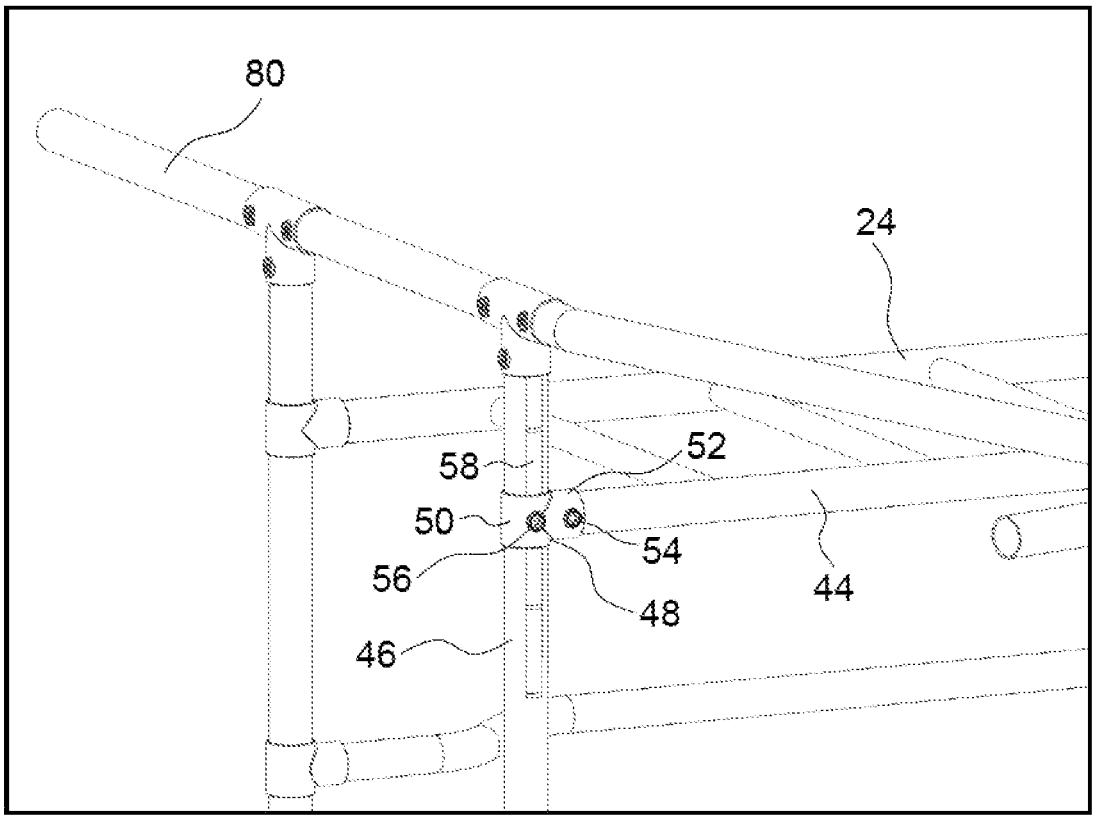
FIG. 8 is an enlarged isometric view of an end region of the monkey bars of the playground apparatus.

Each side of the box-shaped section 42 may comprise a pair of vertically extending poles 46 arranged parallel to one another. The innermost pole of each pair of poles 46 may be aligned with, and therefore delimit, the second ends 22 of the tapered outermost sides 14, 16. The elongate bars 44 of the monkey bars 24 may be connected to the vertically extending poles 46. As best shown in FIG. 8, each of the elongate bars 44 may be connected to each vertically extending pole 46 by a clamp assembly 48. Each clamp assembly 48 may comprise a vertically oriented cylindrical sleeve 50 having an internal lumen extending longitudinally therethrough that slidably receives the relevant vertical pole 46.

A laterally oriented cylindrical support member 52 may be provided on an inwardly-facing side of the sleeve 50. The support member 52 may have an internal cylindrical cavity that receives and supports a peripheral end of the relevant elongate bar 44. The support member 52 may comprise a grub screw 54 that threadedly engages into a complementary threaded bore provided in a side of the support member 52. During assembly of the playground apparatus 10, the end of the elongate bar 44 is slotted into the cavity of the support member 52 and the grub screw 54 may then be turned causing it to bear against the end of the bar 44 in the cavity to secure it therein.

The sleeve 50 of each clamp assembly 48 slidably engages the vertical poles 46 to allow the height of the monkey bars 24 to be adjusted relative to the ground surface. The sleeve 50 may comprise a grub screw 56 that threadedly engages into a complementary threaded bore provided in a side of the sleeve 50. Turning the grub screw 56 causes it to bear against the vertical pole 46. The set of grub screws 56 may, therefore, be used to lock the monkey bars 24 in position once they have been adjusted to a desired height. Each of the vertical poles 46 may comprise a measuring scale 58 displayed on its side having reference markers to allow the person assembling the apparatus 10 to move the monkey bars 24 to one of several prescribed marked heights.

The uppermost pole 36 and the lowermost pole 38 of each outermost side 14, 16 of the frame 12 may also be connected to the box-shaped section 42 by a pair of further clamp assemblies 60. During assembly of the playground apparatus 10, the innermost ends of the poles 36, 38 may be inserted into and held by the clamp assemblies 60. It is important to ensure that, when clamped, the innermost ends are rotatably oriented about their respective longitudinal axes correctly such that the poles 36, 38 extend away from the box-shaped section 42 in the right direction. If the innermost ends are not oriented correctly, then the outermost ends of the poles 36, 38 cannot be connected to the upright supports poles 28. The clamp assemblies 60 may, therefore, be configured such that the innermost ends of the poles 36, 38 can only be clamped when they are in the correct orientation.

Figure 9A:
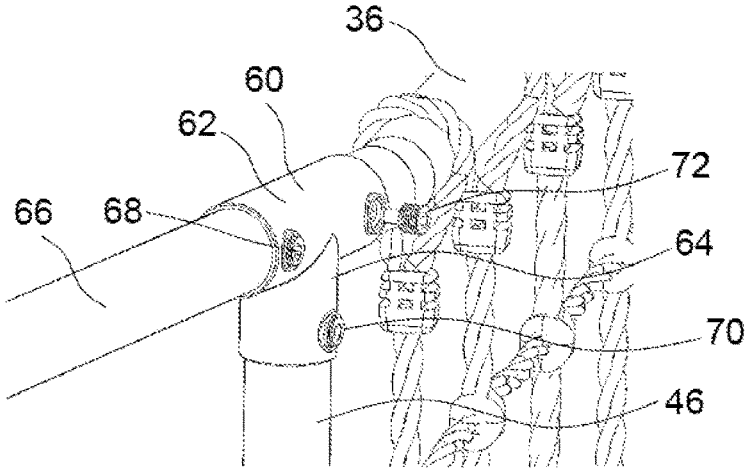
FIG. 9A is an enlarged isometric view of a bracket assembly of the playground apparatus, wherein one of the screws of the bracket assembly is shown disengaged from the bracket assembly.
Figure 9B:
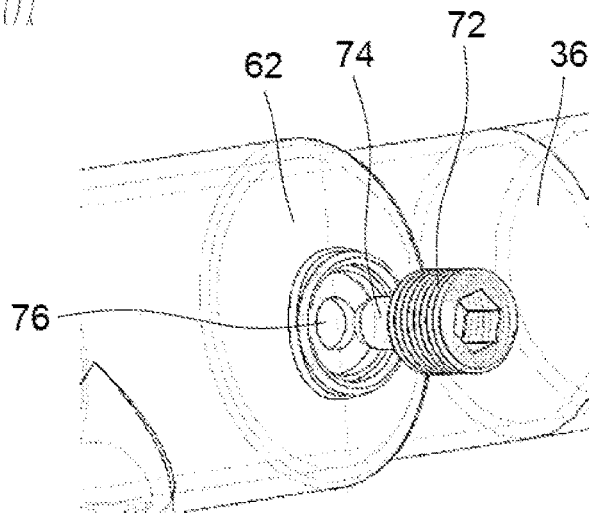
FIG. 9B is a further enlarged isometric view of the bracket assembly and disengaged screw.
Figure 9C:
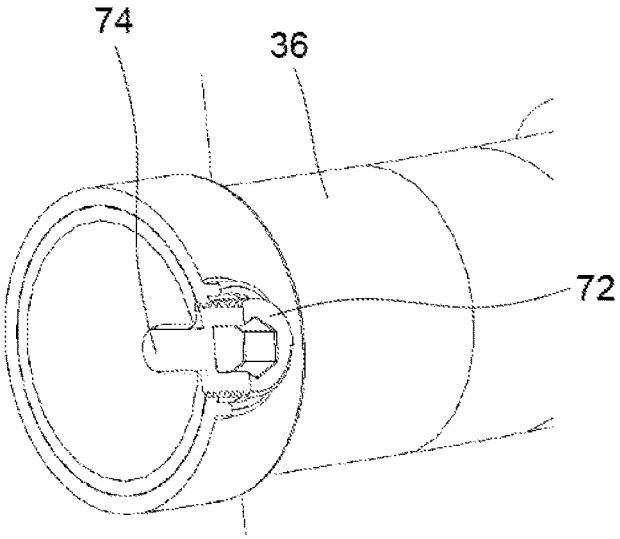
FIG. 9C is an enlarged cross-sectional isometric view of the bracket assembly, wherein the screw is shown engaged in the bracket assembly.

Referring to FIGS. 9A to 9C, one of these clamp assemblies 60 is depicted, which is used to connect one of the uppermost poles 36 to the uppermost end of an innermost pole 46 of the box-shaped section 42. The clamp assembly 60 comprises a horizontal pipe section 62 and a vertical pipe section 64 connected together in a T-shaped arrangement. The horizontal pipe section 62 may comprise a pair of opposed open ends that provide clamp members to receive, respectively, the uppermost pole 36 and an uppermost pole 66 of the box-shaped section 42. A lowermost end of the vertical pipe section 64 may receive the innermost pole 46 of the box-shaped section 42. The clamp assembly 60 may comprise first and second grub screws 68, 70 that threadedly engage into complementary threaded bores provided in, respectively, the horizontal and vertical pipe sections 62, 64 for locking the uppermost pole 66 and innermost pole 46 in the clamp assembly 60.

The clamp assembly 60 may comprise a screw 72 which is operatively configured to lock the uppermost pole 36 in the clamp assembly 60. As shown in FIGS. 9B and 9C, the screw 72 may comprise an inwardly extending lug 74. The lug 74 may be adapted to engage in a mating arrangement with an aperture 76 provided in the end of the uppermost pole 36 that is inserted into the horizontal pipe section 62. The screw 72 and aperture 76 are arranged such that the lug 74 can only enter the aperture 76 when the end of the uppermost pole 36 is disposed in the horizontal pipe section 62 by the correct distance and in the correct rotational orientation. The clamp assemblies 60 that are provided at a base end of the box-shape frame section 42 may also comprise equivalent screw, lug and aperture arrangements that provide that the lowermost poles 38 may only be engaged by the clamp assemblies 60 when the poles 38 are positioned and oriented correctly.

The frame 12 may also comprise a pair of outwardly extending bull bars 78 that are mounted to uppermost ends of the upright support poles 28. As best shown in FIG. 4, the bull bars 78 may extend diagonally outwards towards the outermost end 20 of the frame 12 from a common centre point 79 disposed between the two tapered sides 14, 16. The frame 12 may also comprise a pair of rearwardly extending bars 80 attached to uppermost ends of the box-shaped frame section 42. The two sets of bars 78, 80 allow items of play equipment to be hung from the frame 12. The box-shaped section 42 may comprise a laterally extending pole 82 spanned between the two outermost vertically extending poles 46. As best shown in FIG. 4, the pole 82 may be contorted along its longitudinal axis such that it comprises an intermediate portion 84 that is disposed away from the outermost elongate bar 44 of the monkey bars 24. In this configuration, the pole 82 stays out of the way of the user of the apparatus 10 when they are swinging underneath the monkey bars 24.

Figure 10:
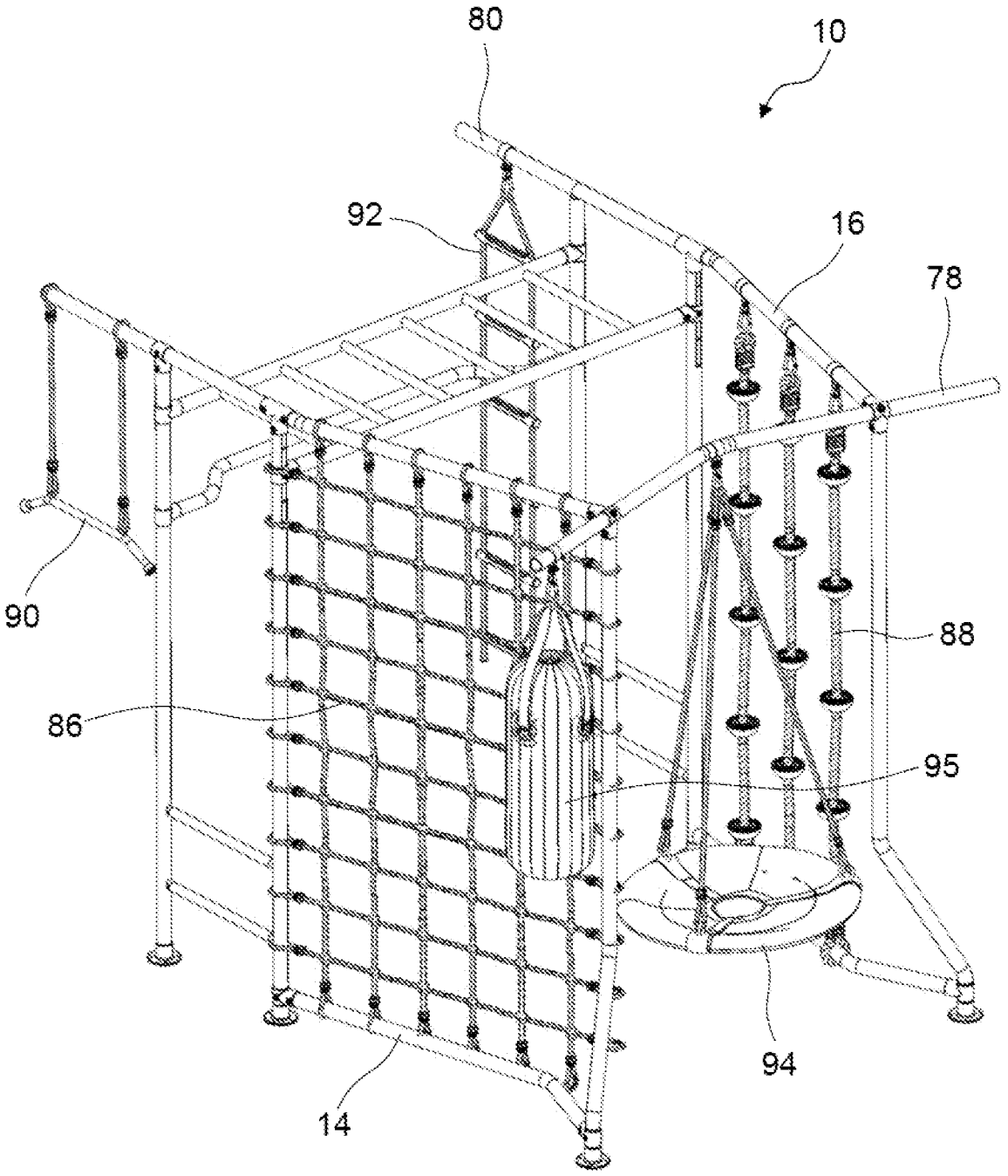
FIG. 10 is an isometric view of the playground apparatus is shown with various items of play equipment attached to the apparatus.

The frame 12 provides a stable structure that various items of play equipment may be conveniently attached to. For example, as shown in FIG. 10 a cargo net 86 may be attached to one of the tapered side sections 14 of the frame 12. A set of ropes 88 provided with grippable handles may be attached to the opposite tapered side section 16 and extend vertically between the uppermost and lowermost poles 36, 38 of the side section 16. A trapeze bar 90 may be attached to one of the rearwardly extending bars 80 and a rope ladder 92 may be attached to the opposite rearwardly extending bar 80. A net swing 94 may be attached to the middle of the bull bars 78 and a punching bag 95 may be attached to an end of the bull bars 78.

Figure 11:
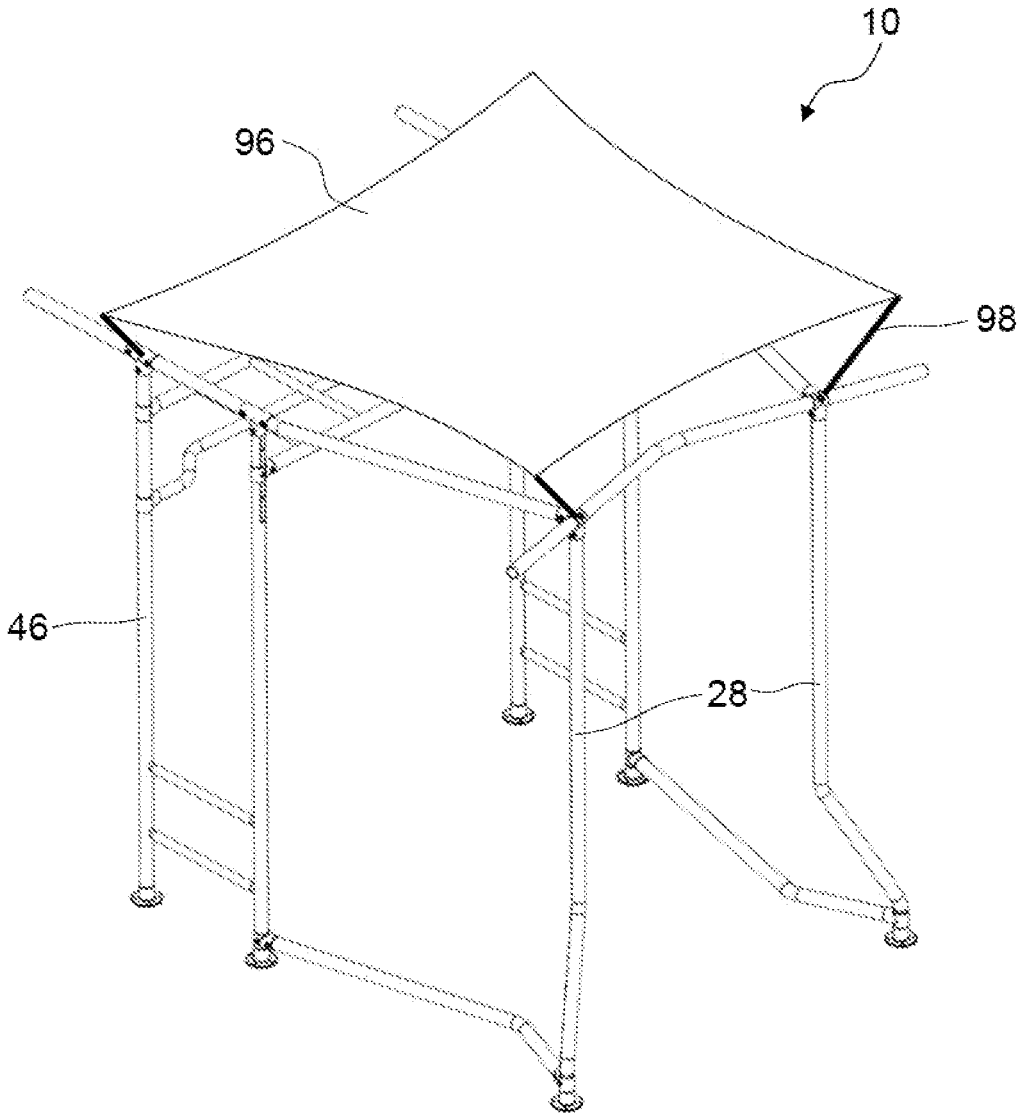
FIG. 11 is an isometric view of the playground apparatus shown with a shade cover attached to the frame of the apparatus.

Referring to FIG. 11, in other examples the playground apparatus 10 may be provided with a shade cover 96. The shade cover 96 may be held in an elevated position above the frame 12 by a plurality of struts 98 that upwardly extend from an uppermost end of the frame 12. Each of the struts 98 may be fixedly connected to the frame 12. For example, the struts 98 may be welded to the uppermost end of the frame 12. In another example, the uppermost ends of vertical poles 28, 46 may upwardly protrude from the uppermost end of the frame 12 to provide the struts 98.

In another example, the struts 98 may be removably attachable to the frame 12 by a set of clamp assemblies (not shown) that engage with the uppermost perimeter end of the frame 12. The clamp assemblies may allow the shade cover 96 to be conveniently attached and detached as required. The shade cover 96 may comprise a cloth-like material that is held taught by the struts 98. For example, the cover 96 may comprise a tough woven fabric material such as Hessian. In another example, the cover 96 may be made of a waterproof material such as polyvinyl chloride (PVC) fabric, or woven polyester yarn coated on one or both sides with PVC. It will be appreciated that the shade cover 96 does not necessarily need to be held in an elevated position above the frame 12. For example, the shade cover 96 may simply be attached to, and extend across, the uppermost end of the frame 12 using a set of clips. The monkey bars 24 may be connected to poles 46 at a suitable height such that the user's hands do not come into contact with the shade cover 96 during use in such examples.

As noted in the preceding paragraphs, the section of the frame 12 that is bounded by the outermost sides 14, 16 inwardly tapers towards the outermost end 20 of the apparatus 10. That is to say, the overall width of the frame section decreases progressively from the second ends 22 to the first ends 18 of the sides 14, 16. In use, this configuration advantageously provides that (i) the weight distribution of the frame 12 is inwardly concentrated towards the outermost end 20, (ii) the upright support poles 28 are arranged at positions that are laterally inwards of the second ends 22 of the sides 14, 16, and (iii) the lowermost sections 32 of the support poles 28 extend from the foregoing positions outwardly away from one another and towards the outermost end 20 of the apparatus 10. In this configuration, the frame 12 remains stable when the user of the apparatus 10 is hanging and swinging from the monkey bars 24. The frame 12 does not, therefore, require any outwardly extending support devices to remain stable, such as extension legs or braces. The surface area footprint of the frame 12 is advantageously kept to a minimum and the apparatus 10 is suitable for installation and use on small areas of land, including small lawns and courtyard areas. The frame 12 also advantageously remains stable when the user is playing with items of play equipment hanging from the frame 20 during use, such as net swings 94 and punching bags 95. This includes, in particular, when the relevant play equipment is suspended from parts of the frame 20 disposed towards the outermost end 20.

For additional safety, the feet 40 of the apparatus 10, and/or the ground engaging ends of the upright poles 28, 46 of the apparatus 10, may be provided with small anchor devices, such as small earth screws, that engage into a soft ground surface underneath the apparatus 10. Because the frame 12 is inherently stable, these anchor devices advantageously only need to extend into the soil to a shallow depth. The devices can, therefore, be supplied at negligible additional cost and they do not interfere with underground water pipes and power cables that may be underneath the apparatus 10 at the point of installation.

Figure 12:
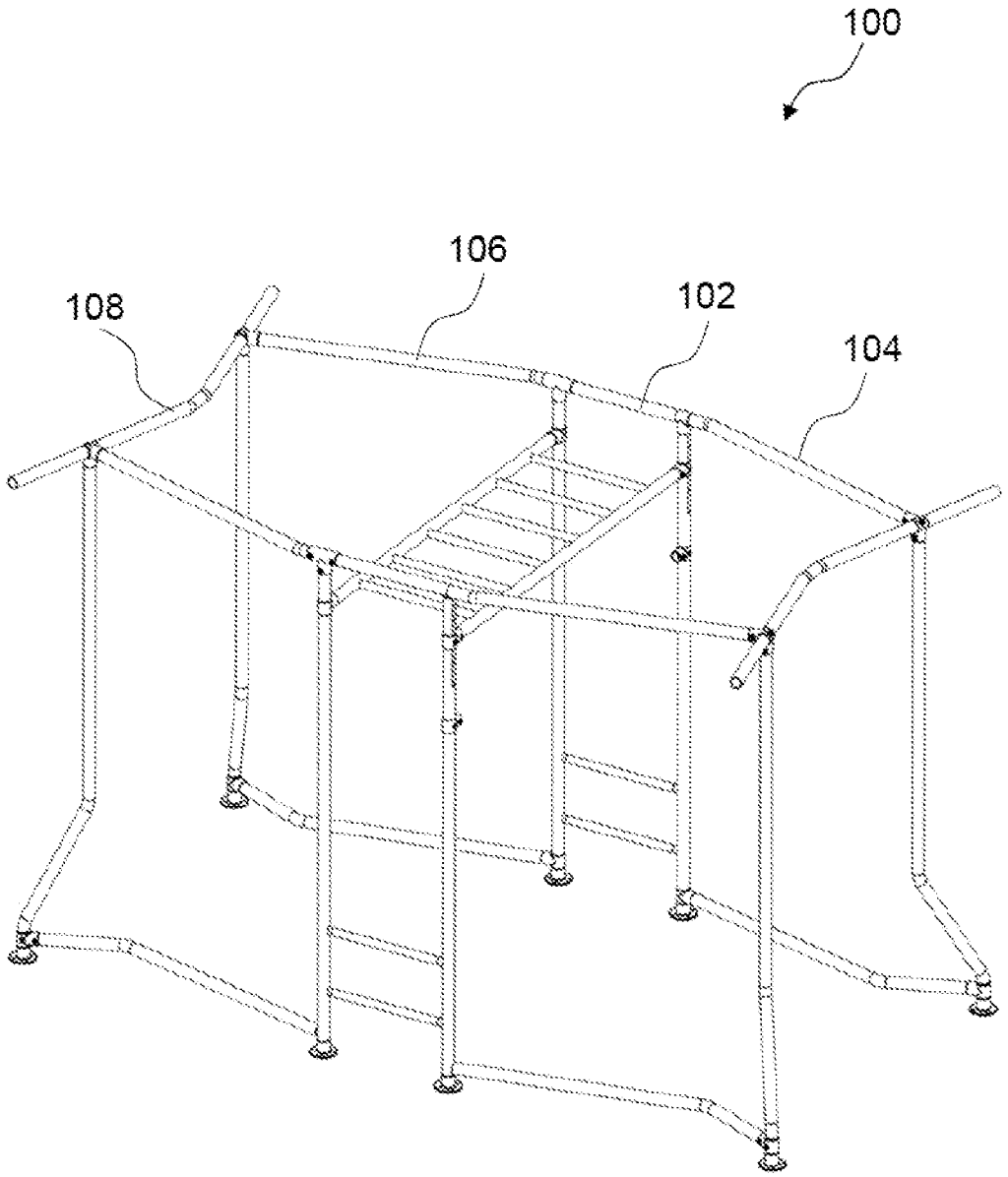
FIG. 12 is an isometric view of a playground apparatus according to a further example embodiment of the invention.
Figure 13:
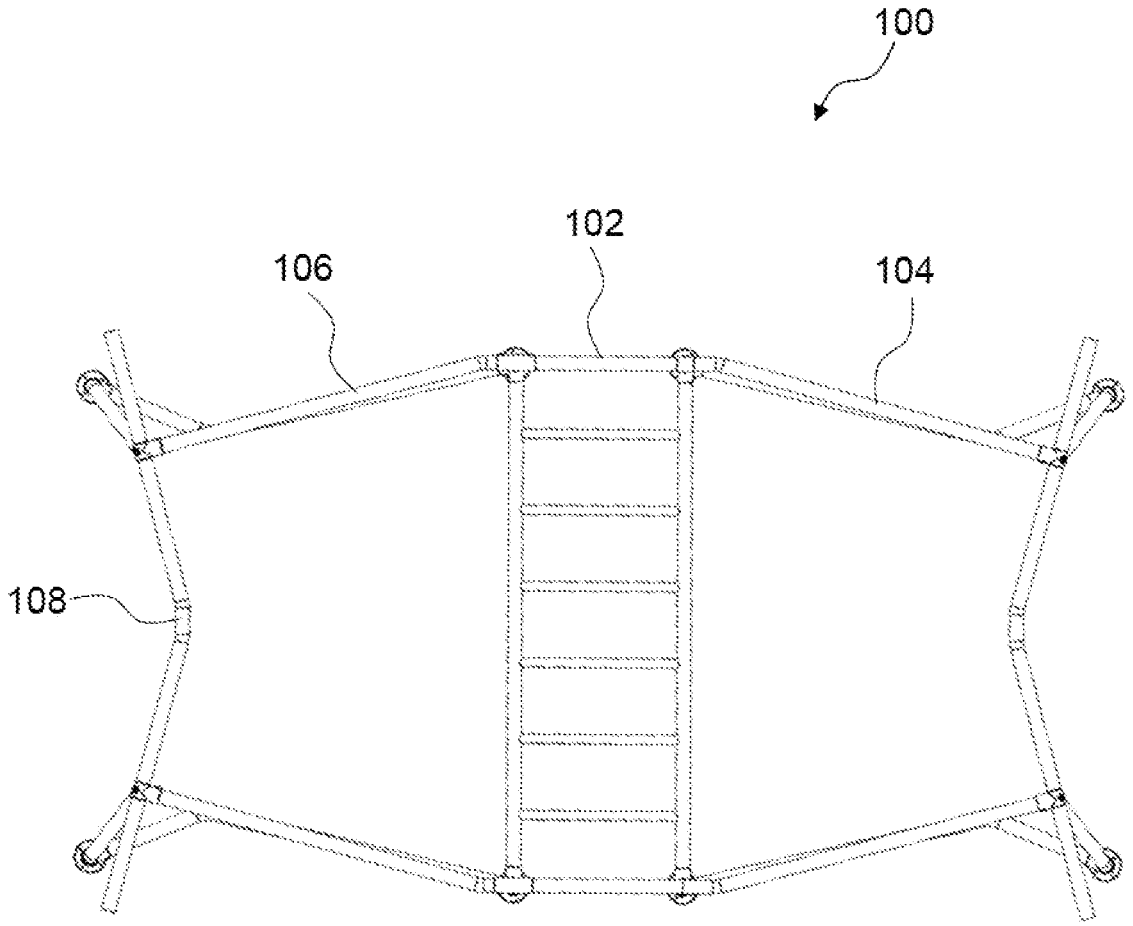
FIG. 13 is a plan view of the playground apparatus of FIG. 12.
Figure 14:
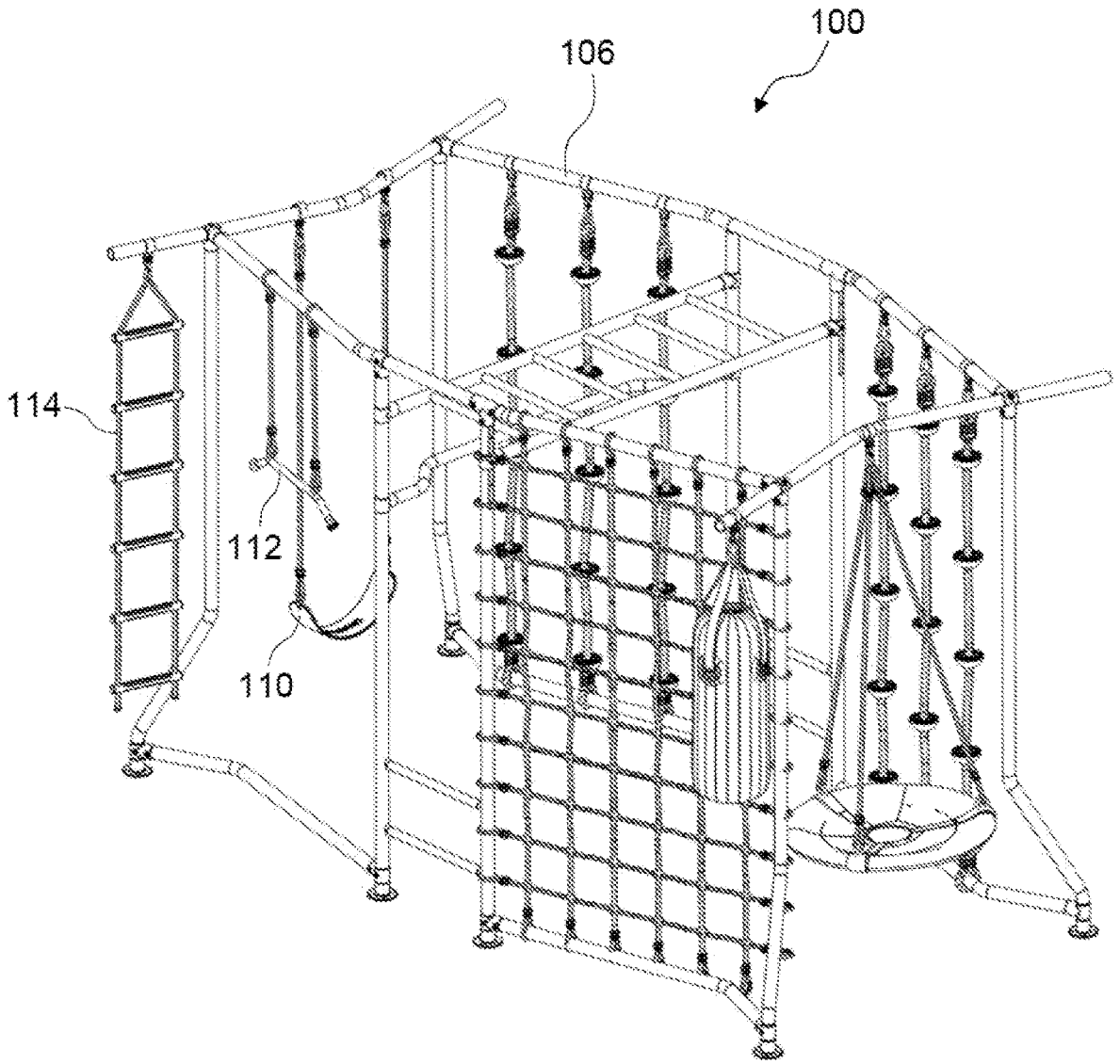
FIG. 14 is a further isometric view of the playground apparatus of FIG. 12, wherein the playground apparatus is shown with various items of play equipment attached to the apparatus.

Referring to FIGS. 12 to 14, a playground apparatus 100 according to a further example embodiment of the invention is shown. The apparatus 100 comprises a box-shaped frame section 102 with monkey bars and an outwardly extending frame section 104 that has inwardly tapering sides substantially as provided in the example depicted in FIGS. 1 to 11. However, the apparatus 100 also comprises a second outwardly extending frame section 106, wherein a pair of sides of the second frame section 106 inwardly taper towards an outermost end 108 of the apparatus 100 opposed to frame section 104. The apparatus 100 provides additional frame members for the user to climb on and/or to attach items of play equipment. For example, as shown in FIG. 14, a swing 110, trapeze bar 112 and/or rope ladder 114 may be attached to the frame section 106.

Figure 15:
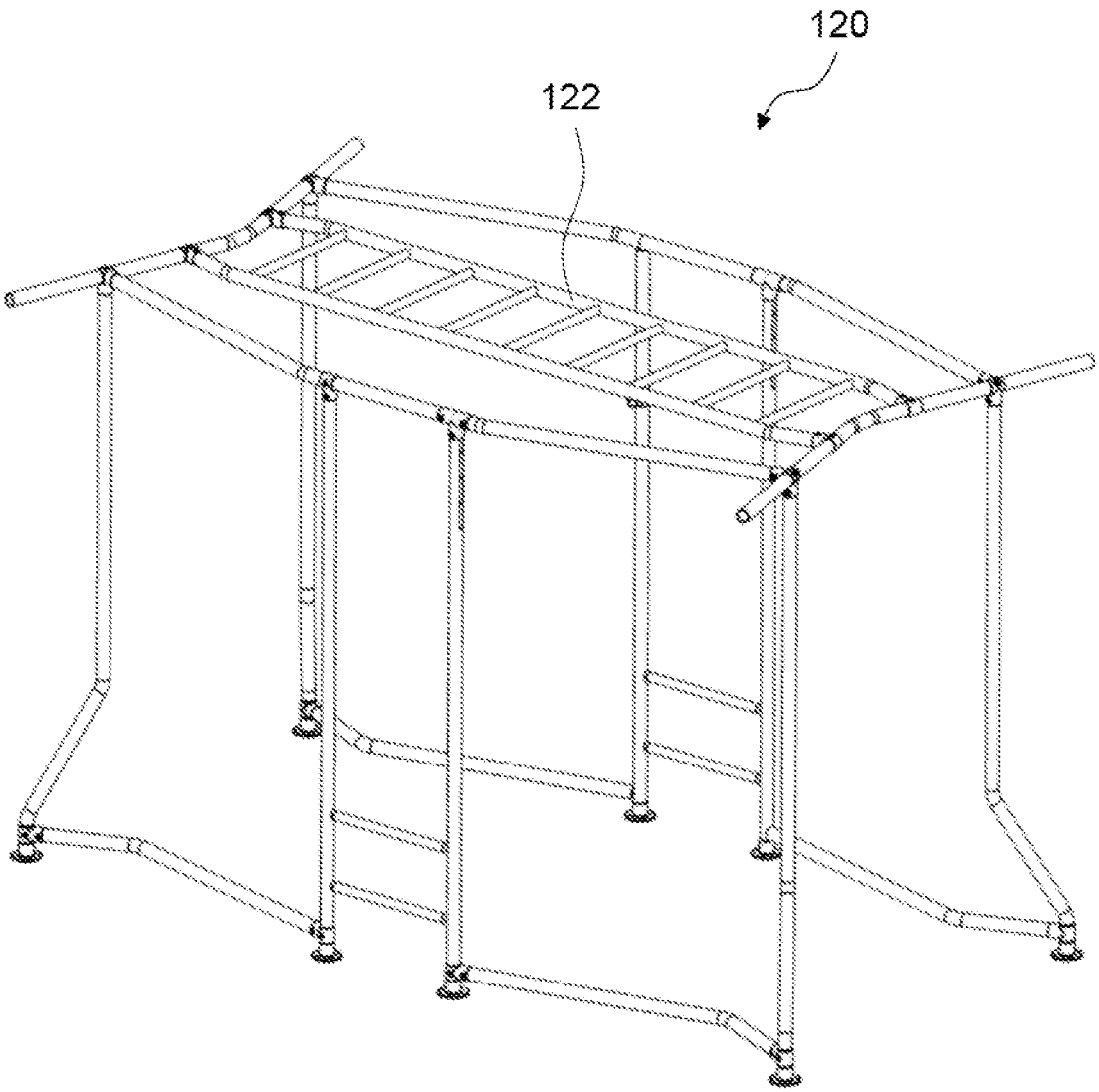
FIG. 15 is an isometric view of a playground apparatus according to a further example embodiment of the invention.

In each of the examples depicted in FIGS. 1 to 11 and FIGS. 12 to 14, the monkey bars of the playground apparatus extend laterally between the two sides of the apparatus. Referring to FIG. 15, a playground apparatus 120 according to a further example embodiment of the invention is shown. The apparatus 120 is materially the same as the apparatus 100 depicted in FIGS. 12 to 14 save that the monkey bars 122 of the apparatus 120 extend longitudinally end to end between the two longitudinal frame ends of the apparatus 120.

For the purpose of this specification, the word "comprising" means "including but not limited to", and the word "comprises" has a corresponding meaning.

The above embodiments have been described by way of example only and modifications are possible within the scope of the claims that follow.

The invention claimed is:

1. A playground apparatus, comprising:

a frame adapted to rest on a ground surface, the frame comprising a pair of laterally opposed outermost sides having first ends that are arranged towards an outermost end of the frame and second ends opposed to the first ends, wherein the outermost sides taper inwardly towards the first ends;

monkey bars supported by the frame above the ground surface, wherein the monkey bars comprise a plurality of rungs arranged in a row and configured to allow a user to grasp and swing from the rungs; and at least a pair of upright support poles, wherein uppermost sections of the upright support poles are connected to the frame towards the first ends such that the uppermost sections are laterally inwardly disposed relative to the second ends, and wherein lowermost ends of the upright support poles extend outwardly away from one another and towards the outermost end to increase a surface area of the ground surface engaged by the upright support poles.

2. The playground apparatus according to claim 1, wherein the uppermost sections are substantially vertically oriented, and wherein the lowermost ends extend diagonally relative to the uppermost sections.

3. The playground apparatus according to claim 1, wherein the lowermost ends comprise feet to increase a surface area of the ground surface engaged by the lowermost ends.

4. The playground apparatus according to claim 1, wherein the outermost sides of the frame comprise a plurality of horizontally aligned poles extending towards the outermost end, wherein the horizontally aligned poles are relatively aligned such that they inwardly converge together towards the outermost end, and wherein the upright support poles extend downwardly from the horizontally aligned poles.

5. The playground apparatus according to claim 4, wherein the upright support poles are connected to an uppermost pair of the horizontally aligned poles and to a lowermost pair of the horizontally aligned poles.

6. The playground apparatus according to claim 4, wherein each of the horizontally aligned poles are connected to the frame by clamp members that receive the horizontally aligned poles, wherein the clamp members are provided with fastening means configured to engage the horizontally aligned poles only when the horizontally aligned poles are in a correct rotational orientation relative to the frame.

7. The playground apparatus according to claim 6, wherein the fastening means comprise screws that engage with corresponding apertures provided in the horizontally aligned poles, and wherein the corresponding apertures are positioned such that they receive the screws when the horizontally aligned poles are in the correct rotational orientation.

8. The playground apparatus according to claim 1, wherein the monkey bars are releasably connected to a plurality of vertically extending poles of the frame by a plurality of clamp assemblies.

9. The playground apparatus according to claim 8, wherein the clamp assemblies are configured such that the monkey bars are connectable to the vertically extending poles at an adjustable height relative to the ground surface.

10. The playground apparatus according to claim 8, wherein the clamp assemblies comprise sleeves, wherein the sleeves slidably receive the vertically extending poles, and grub screws that threadedly engage into complementary threaded bores provided in the sleeves, wherein the grub screws operatively bear against sections of the vertically extending poles received in the sleeves.

* * * * *